US007086670B2

(12) United States Patent
Luker

(10) Patent No.: US 7,086,670 B2
(45) Date of Patent: Aug. 8, 2006

(54) LOCK FOR BI-DIRECTIONAL DOORS

(76) Inventor: Graham James Luker, 21/21-25 Bourke Road, Cronulla, New South Wales 2230 (AU)

( * ) Notice: Subject to any disclaimer, the term of this patent is extended or adjusted under 35 U.S.C. 154(b) by 129 days.

(21) Appl. No.: 10/863,128

(22) Filed: Jun. 8, 2004

(65) Prior Publication Data

US 2005/0006907 A1 Jan. 13, 2005

(30) Foreign Application Priority Data

Jun. 12, 2003 (AU) ..... 2003902925

(51) Int. Cl.
*E05C 5/00* (2006.01)

(52) U.S. Cl. ..... 292/68; 292/304; 292/341.17

(58) Field of Classification Search ..... 292/68, 292/69, 156, 157, 159
See application file for complete search history.

(56) References Cited

U.S. PATENT DOCUMENTS 2,264,182 A 11/1941 Miller ..... 292/340
3,563,586 A * 2/1971 Creamer et al. ..... 292/144
3,791,687 A * 2/1974 Schroeder ..... 292/251.5
3,926,460 A * 12/1975 Peterson ..... 292/144
4,509,348 A * 4/1985 Hsu ..... 70/131
4,634,157 A * 1/1987 Fernandez ..... 292/218
5,046,768 A * 9/1991 Myslicki ..... 292/68

FOREIGN PATENT DOCUMENTS

| | | |
|---|---|---|
| AU | 6886981 | 10/1981 |
| CH | 153760 | 4/1932 |
| EP | 0619408 | 10/1994 |
| EP | 1176276 | 1/2002 |
| FR | 2729704 | 7/1996 |

* cited by examiner

*Primary Examiner*—Gary Estremsky
(74) *Attorney, Agent, or Firm*—Jacobson and Johnson

(57) ABSTRACT

There is a lock for a bi-directional door, swing or sliding door 19. The lock includes at least two pins 6, 7 which are spaced apart a distance exceeding the thickness of the door. The pins are adapted for simultaneous arcuate motion about an axis located between said pins 6, 7 and longitudinal movement between withdrawn and protruding positions. When the lock is in a configuration of use and the pins 6, 7 are moved from the withdrawn positions to the protruding positions an edge of the door 19 when placed at a location offset from the axis is engaged by at least one of said pins 6, 7 so that the door is secured at a position substantially over the axis.

9 Claims, 3 Drawing Sheets

LOCK FOR BI-DIRECTIONAL DOORS

FIELD OF THE INVENTION

This invention relates to locks. More particularly, although not exclusively it discloses an improved floor mountable lock for bi-directional swing or sliding doors including glass doors.

BACKGROUND TO THE INVENTION

Glass doors are typically equipped with top and bottom pivots or slides which are installed using patch fittings. A door closer mechanism may also be incorporated with the top or bottom pivot or slide. It is known to secure such doors using either manual or electromechanical locks. These may be mounted either within the door or alternatively in the surrounding frame which may be made of glass, timber or alloy. In particular, for overhead installations at the top of the door electromechanical locks are preferred. However, with transparent glass doors and walls there is a problem with concealment of the wires. With bottom installations it is known to use either manual or electrically operated locks mounted with patch fittings to the lower edge of the door. These typically comprise swing bolts, drop bolts, latches or other vertical locking systems. One problem with floor mounted locks is that dirt accumulates in the floor cavity for the bolt or latch and this inhibits operation of the lock. Also, with both overhead and bottom mounted locks as currently known the door must be accurately positioned at the closed position across the centre-line of the door-sill before the lock can engage. This is a problem with through swinging or bi-directional doors where mechanical stops cannot be fitted. Hydraulic closers are of limited benefit here as the door can still "float" out of centre position by as much as ±20 mm due to manufacturing tolerances in the closure mechanism, wear and wind loading.

OBJECT OF THE INVENTION

It is therefore an object of this invention to ameliorate the aforementioned disadvantages by providing a lock which will both locate and secure a bi-directional swing or sliding doors.

SUMMARY OF THE INVENTION

A lock for a bi-directional swing or sliding doors is disclosed, said lock including at least two pins which are spaced apart a distance exceeding the thickness of said door and are adapted for simultaneous arcuate motion about an axis located between said pins and longitudinal movement between withdrawn and protruding positions whereby when said lock is in a configuration of use and said pins are moved from said withdrawn positions to said protruding positions an edge of said door when placed at a location offset from said axis is engaged by at least one of said pins so that said door secured at a position substantially over said axis.

Preferably the pins move longitudinally through spaced apart apertures in a circular face plate and cover which are rotatable about said axis.

It is further preferred that said pins are moved longitudinally by engagement along an inclined cam surface as said face plate and cover are rotated.

It is further preferred that said lock includes a cylindrical housing which is shaped for insertion into a grouting box or cavity located in the door-sill below the centre-line closed position of the door.

BRIEF DESCRIPTION OF THE DRAWINGS

The currently preferred embodiment of this invention will now be described with reference to the attached drawings in which.

DETAILED DESCRIPTION OF THE PREFERRED EMBODIMENT

Figure 1:
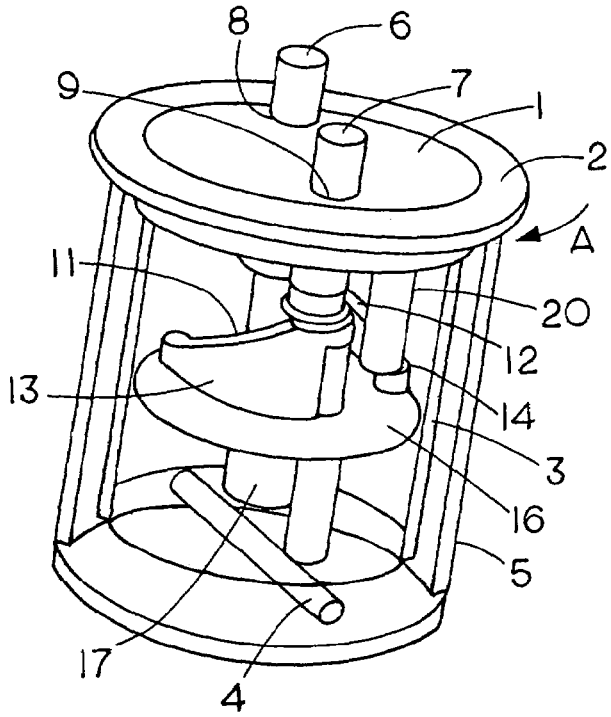
FIG. 1 is a schematic perspective view in partial cross-section of an electromechanical lock according to said invention.

Referring first to FIG. 1 the lock with this embodiment is adapted for floor installation along the sill centre-line of a bi-directional swing or sliding glass doors. In a swing door configuration—it is preferably located at the furthest point from the hinge or pivot. There is a face plate 1 and surrounding dress ring 2 which lie substantially flush with the sill. A cylindrical lock housing 3 extends below and sits on a transverse locating pin 4 in a grouting box 5 set in a sill cavity. There are a pair of pins 6, 7 located in apertures 8, 9 in the face plate which are spaced apart a distance greater than the thickness of the door as shown later in more detail. With this embodiment the pins are spaced apart on a particular pitch circle diameter.

Figure 2:
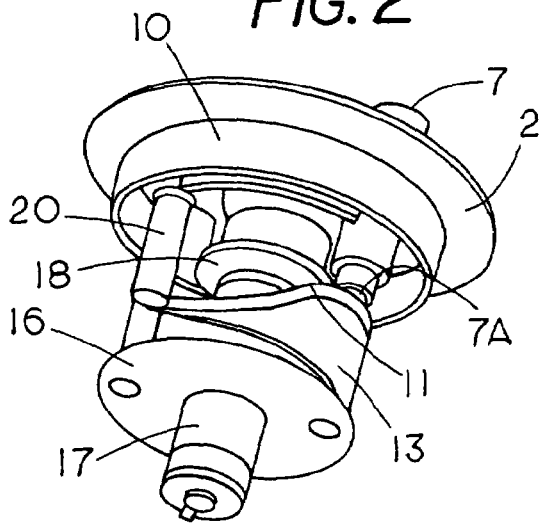
FIGS. 2 and 3 are perspective views of the lock from the bottom and top with the housing omitted.
Figure 3:
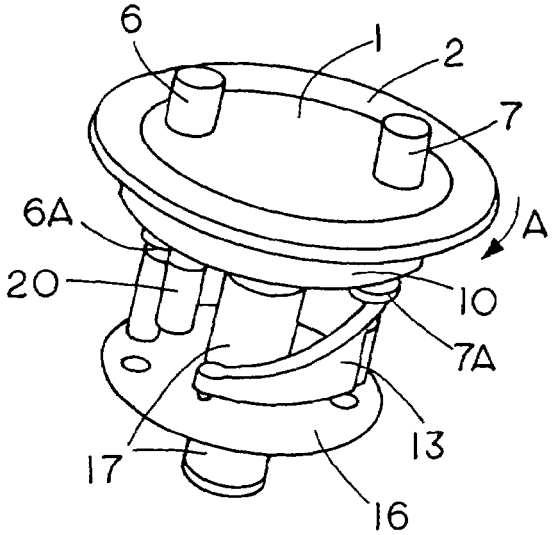

As best shown in FIGS. 2 and 3 the pins 6, 7 also extend down through a cover 10 below the face plate and have ball bearing lower ends 6A, 7A engaging respective surfaces 11, 12 of sloping quadrants hereinafter referred to as cam members 13, 14. These cam members are in turn secured diagonally inside the cylindrical housing 3 above a circuit board or PCB 16. There is an electric motor 17 extending centrally up between the cam members which is also anchored to the lock housing 3 by means of a flange 18 and connecting brackets (not shown). The shaft of this motor extends up to engage in a splined socket in the cover 10 whereby said cover, face plate and pin assembly can be rotated through rise-up and let-down arcs of preferably, but not essentially, 90 degrees relative to the fixing lock housing 3 and cam members 13, 14. In accordance with the direction of rotation the pins therefore follow either rise-up arcs or let-down arcs by riding up or down the sloping cam surfaces 11, 12. Although in FIGS. 1 to 3 the pins are shown at their raised or fully extended locking positions on the upper ends of the cam members rotation of the cover and face plate in the clockwise direction A as shown in FIGS. 1 and 3 would cause the pins to simultaneously follow let-down arcs to withdraw flush with the face plate under spring action. Opposite anticlockwise rotation would simultaneously return the pins to the extended positions shown along the rise-up arcs.

Figure 4:
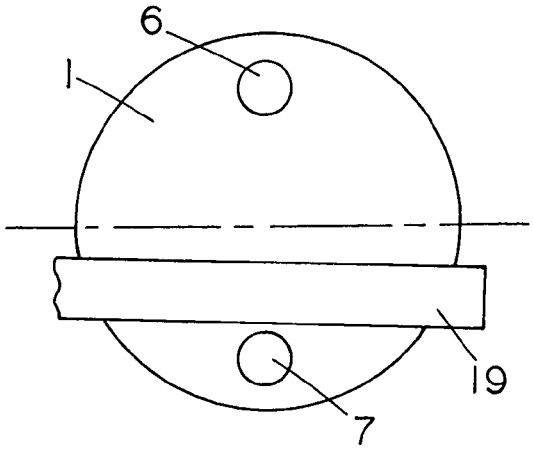
FIGS. 4 to 9 are plan and side elevations of the lock when installed in a door-sill.
Figure 5:
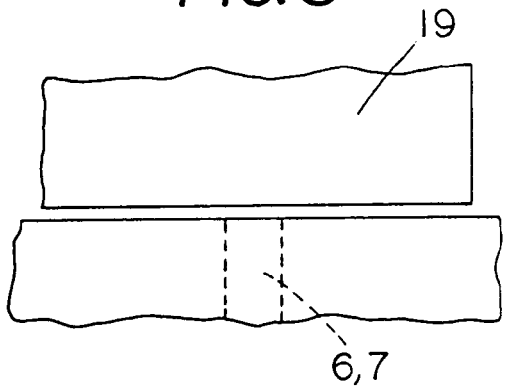
Figure 6:
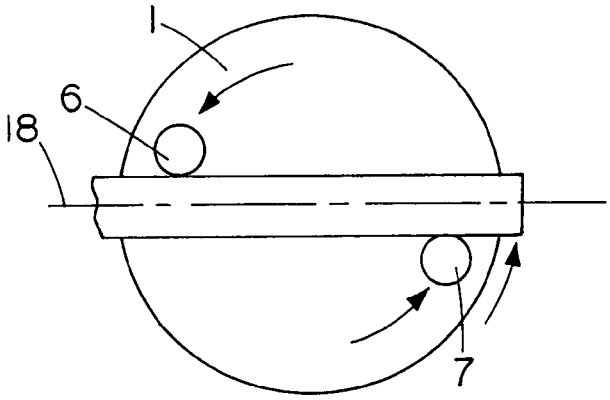
Figure 7:
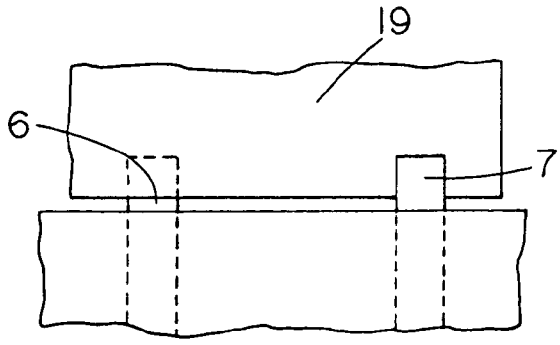

In FIGS. 4 and 5 the pins 6, 7 are directly opposite each other across the door-sill centre-line 18 and are withdrawn flush with the face plate 1 so that the door 19 is free to open in either direction. When not in use the door 19 would position itself roughly between the pins 6, 7 as shown using any suitable means such as a hydraulic closing device and need not be directly over the centre-line 18 for the lock to engage. When the lock is activated the face plate 1 is rotated by the motor 17 in the direction shown in FIG. 6 so that the pins 6, 7 simultaneously move along their rise-up arcs to engage the sides of the door 19. By virtue of the symmetrical placement of the pins 6, 7 across the centre-line 18 the door 19 is automatically located directly over said line as shown in FIGS. 6 and 7. The door is then secured by a solenoid pin 20 which extends up into an aperture in the cover 10 and holds it against rotation from the locking position. Unlocking the door is the reverse of the above procedure. With the solenoid pin 20 disengaged the cover 10 and face plate 1 are then rotated by the motor 17 in the opposite direction to simultaneously withdraw the pins 6, 7 along their let-down arcs to positions flush with the face plate 1 and clear of the door 19.

Figure 8:
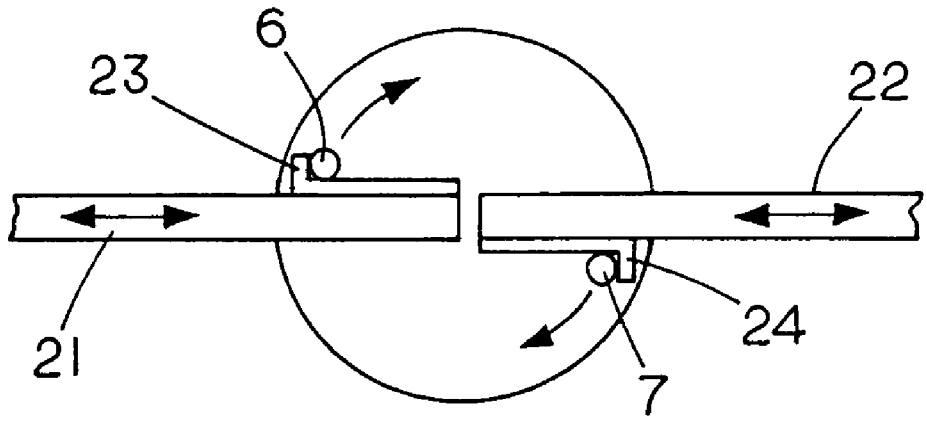
Figure 9:
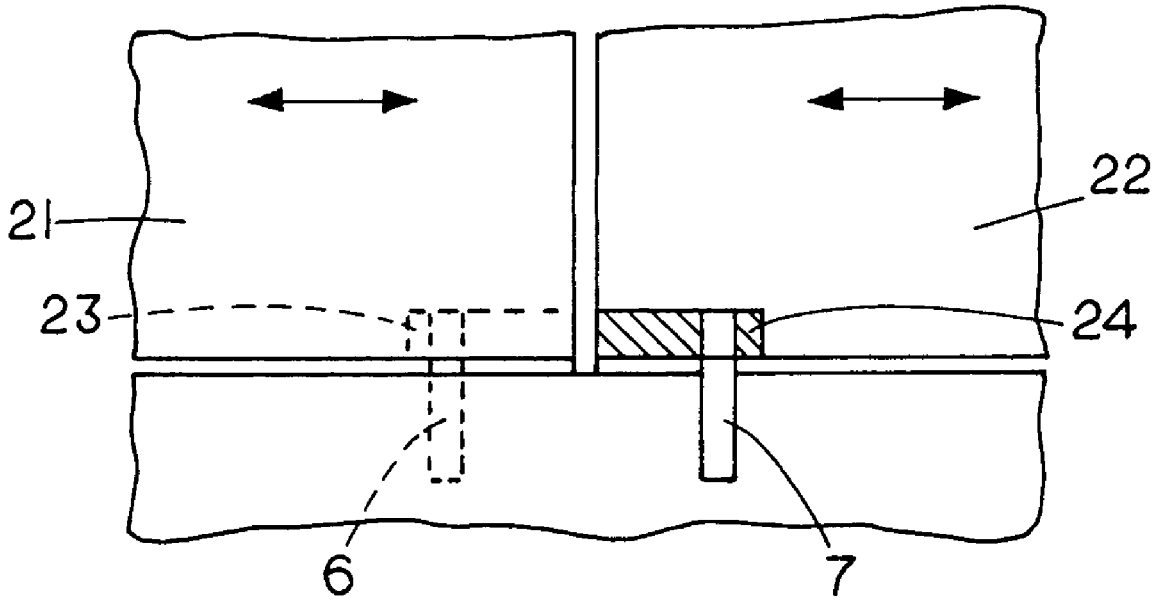

In a bi-directional sliding door configuration as shown in FIGS. 8 and 9 the locking of doors 21, 22 together by pins 6, 7 is assisted by catches 23, 24 or similarly by an integral door shape feature.

Preferably the configuration of the solenoid pin 20 can be set for either "power-to-lock" or "power-to-unlock" operation. The solenoid would be controlled by a system PCB.

Preferably emergency unlocking is also provided whereby the cover 10 and face plate 1 can be induced to rotate by pushing the door 19 until the pins 6, 7 follow their let-down arcs and withdraw below the bottom edge of the door to free it.

The preferred site preparation for installation of the lock would preferably involve drilling a circular cavity in the door-sill as far as possible from the hinge or pivots (in the case of a swing door), and at the common closing datum (in the case of sliding doors) and then securing the cylindrical lock housing 3 and locating pin 4 therein using the grouting box 5. The wiring is preferably tracked through the floor to the drilled cavity for connection to the lock assembly. Preferably the lock assembly is first connected to the wires before being placed into the housing 3. A retaining plate then secures the assembly and housing together.

The orientation of the lock relative to the door is important. When the pins are raised the door is preferably constrained with a maximum float of about ±5 mm. Upon unlocking the pin let-down arcs should be on the same side as when the door was locked.

Preferably the lock is compatible with most access control systems and includes additional features as required by said systems. Lock voltage is preferably, although not essentially, between 12 and 24 vdc. Upon receiving a command to lock the electronics will preferably wait until the door 19 or doors 21, 22 are in the correct proximity. This may be done by using a magnet secured to the door edge(s) lining up with a hall effect in the face plate, cover or housing of the lock. Upon confirmation of approximate door location the motor 17 will then proceed to rotate the cover and face plate to bring the pins 6, 7 up to arrest, locate and secure the door. To open the door a signal from the access control withdraws the solenoid pin 20 and again activates the motor 17 to reverse the process.

It will thus be appreciated that this invention at least in the form of the embodiment disclosed provides a novel and improved form of self-centering lock for bi-directional swing doors, or locking for the case of bi-directional sliding doors. Clearly however the example described is only the currently preferred form of the invention and a wide variety of modifications may be made which would be apparent to a person skilled in the art. For example the shape of the lock housing and face plate as well as the configuration of the cam members, the type of electronics and the installation procedure used may be changed according to design requirements.

The invention claimed is:

1. A lock for a bi-directional swing or sliding door, said lock including at least two pins which are spaced apart a distance adapted to exceed the thickness of said door with which said lock is intended to be used and are adapted for simultaneous arcuate motion about an axis located between said pins and longitudinal movement between withdrawn and protruding positions, whereby when said lock is in a configuration of use with said door and said pins are moved from said withdrawn positions to said protruding positions, an edge of said door placed at a location offset from said axis is engaged by at least one of said pins so that said door is secured at a position substantially over said axis and said lock further including a face plate with spaced apart apertures for the longitudinal movement of said pins therethrough and inclined cam surfaces for effecting said longitudinal movement by engagement with said pins.

2. The lock as claimed in claim 1 wherein said face plate is circular.

3. The lock as claimed in claim 2 wherein said cam surfaces are arranged so that rotation of said face plate in one direction corresponds with longitudinal movement of the pins to said protruding positions and rotation of the face plate in the opposite direction corresponds with longitudinal movement of the pins to said withdrawn positions.

4. The lock as claimed in claim 3 wherein there is an electric motor mounted in a housing for the lock which rotates said face plate.

5. The lock as claimed in claim 3 wherein there is a solenoid pin which is extendible into the face plate to secure said face plate against rotation when the pins are in said protruding positions.

6. The lock as claimed in claim 4 wherein said housing is cylindrical and is shaped for mounting into a grouting box or cavity located in a door-sill.

7. The lock as claimed in claim 5 wherein said solenoid pin can be set for either power-to-lock operation or power-to-unlock operation.

8. The lock as claimed in claim 1 wherein the arcuate motion about said axis extends through 90 degrees.

9. The combination, including the lock of claim 1 mounted on one of a bi-directional swing door or a sliding door.

* * * * *